US005438894A

United States Patent [19]

Pearce

[11] Patent Number: 5,438,894

[45] Date of Patent: Aug. 8, 1995

[54] SOCKET WRENCH EXTENSION

[76] Inventor: Dan C. Pearce, 1741 S. Hill St., Oceanside, Calif. 92054

[21] Appl. No.: 280,772

[22] Filed: Jul. 25, 1994

[51] Int. Cl.[6] ..... B25B 13/00

[52] U.S. Cl. ..... 81/177.2; 81/177.85; 81/124.7

[58] Field of Search ..... 81/177.1, 177.2, 177.5, 81/177.85, 121.1, 124.3, 124.6, 124.7

[56] References Cited

U.S. PATENT DOCUMENTS

| | | | |
|---|---|---|---|
| 949,711 | 2/1910 | McLane | 81/124.7 X |
| 3,561,510 | 2/1971 | Johnson | 81/177.5 X |
| 3,875,829 | 4/1975 | Evans et al. | 81/177.2 X |
| 4,004,476 | 1/1977 | DeVrou | 81/177 A |
| 4,125,913 | 11/1978 | Lewis | 7/138 |
| 4,344,340 | 8/1982 | Erickson | 81/177 A |
| 4,356,852 | 11/1982 | Smith | 145/61.1 |
| 4,733,584 | 3/1988 | Karge | 81/177.85 |
| 4,754,670 | 7/1988 | Raymond | 81/177.2 |
| 4,817,475 | 4/1989 | Kelly et al. | 81/177.85 X |
| 4,817,476 | 4/1989 | Karge | 81/177.85 |
| 4,825,733 | 5/1989 | Chinchar | 81/177.2 |
| 4,856,388 | 8/1989 | Freeman | 81/177.2 |
| 5,216,940 | 6/1993 | Hedden | 81/177.2 |
| 5,257,557 | 11/1993 | Battten | 81/177.85 |

FOREIGN PATENT DOCUMENTS

| | | | |
|---|---|---|---|
| 648559 | 12/1928 | France | 81/177.5 |

*Primary Examiner*—D. S. Meislin
*Attorney, Agent, or Firm*—Calif Tervo

[57] ABSTRACT

A socket wrench extension generally comprises a socket mounting bottom end portion, a shank portion and a torque receiving top end portion adapted to receive a variety of torque transferring tools. In a preferred embodiment, the top end portion includes a free end face, an axial, drive-receiving recess in the free end face, and an outer peripheral wall that extends to the free end and is substantially a regular polygon in cross-section having diametrically opposed parallel flats for receiving an open-end wrench, a box wrench, flat reversible ratchet wrench or socket wrench. The top end portion also includes diametrical bores therethrough through each flat and a radially protruding shoulder at the bottom of each flat. The recess includes a bottom end having a slot for receiving a screwdriver drive.

17 Claims, 1 Drawing Sheet

FIG. 1
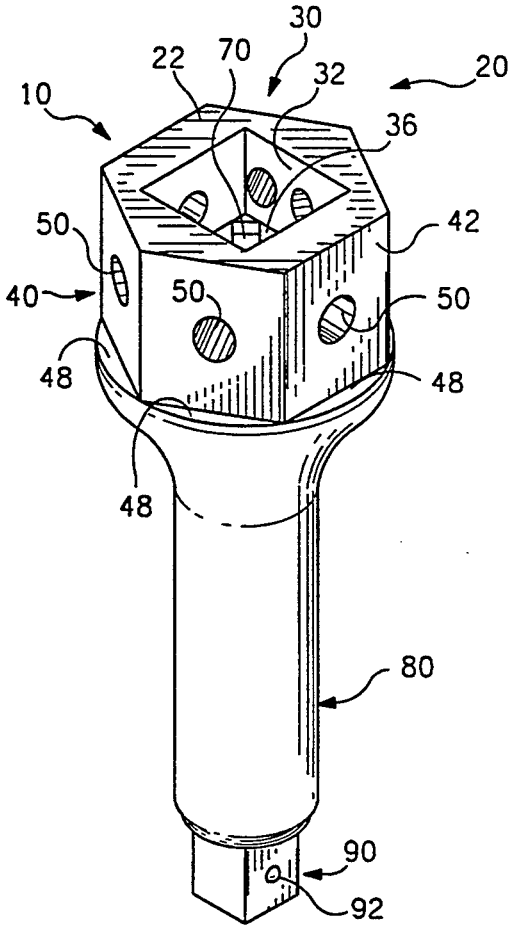
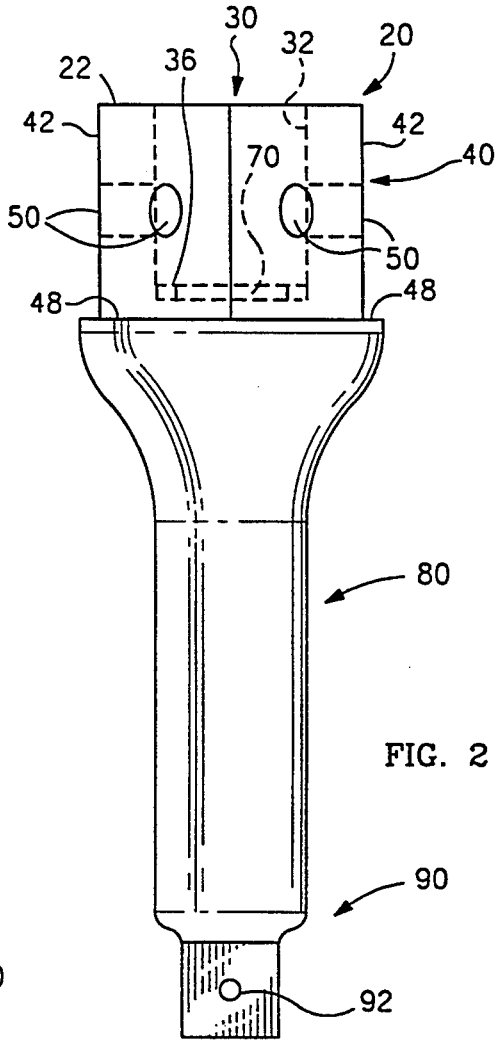
FIG. 2
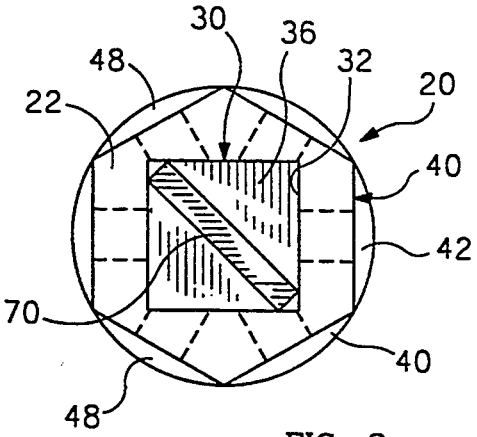
FIG. 3

SOCKET WRENCH EXTENSION

BACKGROUND OF THE INVENTION

1. Field of the Invention

This invention relates in general to extension drive tools for transferring torque and more specifically to an extension drive for a socket wrench extension having a plurality of torque receiving appurtenances.

2. Description of the Related Art

Socket wrenches are commonly used to turn fasteners, such as bolts. A socket is placed over the bolt and a drive tool is inserted in a socket cavity for transferring torque to the socket wrench. Typically a ratchet driver is used directly as a drive tool. Often an elongated extension drive is used between the ratchet driver and the socket. Extensions sometimes allow work to be performed in narrow or confined areas where a ratchet wrench could not be placed or turned. Sometimes there is room for an extension but no room at all for a ratchet drive, i.e. there is no room to add anything to the length of the extension. Sometimes, it is possible to transfer torque to the drive only axially. Sometimes, the proper ratchet drive is not available.

Often, also, in situations requiring low torque, such as starting a bolt or un-screwing a bolt after loosening, a user will simply turn an extension by hand. Typical extension drives are round smooth metal, often slippery, that are not adapted for applying a torque except by way of a ratchet drive.

Therefore, it is desirable to have an extension drive having a variety of torque receiving appurtenances without sacrificing the advantages of small size.

U.S. Pat. No. 4,004,476 of DeVrou titled "SOCKET WRENCH EXTENSION GRIP" recognizes the desirability of being able to apply torque to an extension drive and proposes a flexible gripable cover for the extension. The grip can only be used to transfer small amounts of torque.

U.S. Pat. No. 4,825,733 of Chinchar proposes a wrench having a variety of torque receiving appendages. The wrench is large and not suitable to small space requirements.

SUMMARY OF THE INVENTION

This invention is socket wrench extension and it generally comprises a socket mounting bottom end portion, a shank portion and a torque receiving top end portion adapted to receive a variety of torque transferring tools.

According to a preferred embodiment, the top end portion includes a free end face, an axial, drive-receiving recess in the free end face, and an outer peripheral wall that extends to the free end and is substantially a regular polygon in cross-section having diametrically opposed parallel flats for receiving an open-end wrench, a box wrench, a flat reversible ratchet wrench or socket wrench. The top end portion also includes diametrical bores therethrough through each flat and a radially protruding shoulder at the bottom of each flat. The recess includes a bottom end having a slot for receiving a screwdriver drive.

Other features and many attendant advantages of the invention will become more apparent upon a reading of the following detailed description together with the drawings in which like reference numerals refer to like parts throughout.

BRIEF DESCRIPTION OF THE DRAWING

FIG. 1 is a perspective view of the extension drive.
FIG. 2 is a side elevation view.
FIG. 3 is a top plan view.

DETAILED DESCRIPTION OF THE INVENTION

With reference now to the drawings, there is shown a preferred embodiment of the socket wrench extension, denoted generally as 10, of the invention. Extension 10 includes a tool mounting bottom end portion, denoted generally as 90, a shank portion, denoted generally as 80 and a torque receiving top end portion, denoted generally as 20. Top end portion 20 is adapted to receive a variety of torque transferring tools.

Bottom end portion 90, is configured for transferring torque to a tool, such as a socket, and may be of common square configuration, as shown, or other suitable configuration for transferring torque. Bottom end portion 90 may include a spring-loaded detent ball 93 for retaining an attached tool.

Shank 80, an elongate portion transferring torque from top end 20 to bottom end 90, has a vertical longitudinal axis. Shank 80 is preferably circular in cross-section, but may be of other suitable cross-section. The length of shank 80 determines the length of extension 10. Common extension lengths vary between one and twelve inches.

Top end portion 20 is adapted to receive a plurality of torque inducing tools. Top portion 20 includes a free end face 22 and an axial, drive-receiving recess 30 in free end face 22. Recess 30 is polygonal in cross-section and includes a plurality of side walls 32 for receiving an external polygonal drive, such as a standard square drive, from a ratchet drive. As shown, recess 30 is adapted to receive a one-half inch square drive and bottom end portion is a one-quarter inch square drive. However, this could be reversed or both recess and drive could be the same size. Recess 30 has a bottom end 36.

Slot 70 in recess bottom end 36 is adapted for receiving a flat end screwdriver drive. Preferably, screwdriver slot 70 is oriented to have maximum length such that it traverses between diametrically opposite side wall joints of recess 30, as shown.

Top end portion 20 includes a peripheral outer wall 40 disposed horizontally radially from recess 30 and having diametrically opposed parallel flats 42 for horizontally receiving the jaws of an open-end wrench, i.e. the wrench and jaws are horizontal. Preferably, peripheral wall 40 is a regular polygon, such as hexagon illustrated, in cross-section and extends to free end 22 such that it can receive a box wrench, a flat reversible ratchet wrench or socket wrench. A radially protruding lip or shoulder 48 at the bottom of flats 42 retains an open-end wrench on flats 42 by preventing it from slipping down over shank 80.

A plurality of angularly spaced diametrical bores 50 pass through top portion 20. Preferably, a bore 50 passes through each said flat 42. As shown, bores 50 also pass through recess 30. A handle in the form of a rod can be inserted in a bore 50 to aid in applying a torque to extension 10.

Having described the invention, it can be seen that it provides a very convenient device for applying torque or additional torque to a socket.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A socket wrench extension including:
a tool mounting bottom end portion;
a shank portion; and
a torque receiving top end portion including:
a free end face;
an axial, drive-receiving recess in said free end face; said drive-receiving recess including a bottom end including a slot for receiving a screwdriver drive.

2. The extension of claim 1 wherein:
said top end portion includes:
a diametrical bore therethrough.

3. The extension of claim 1 wherein:
said top end portion includes:
a plurality of angularly spaced diametrical bores therethrough.

4. A socket wrench extension including:
a tool mounting bottom end portion;
a shank portion; and
a torque receiving top end portion including:
a free end face;
an axial, drive-receiving recess in said free end face; said drive-receiving recess including a bottom end including a slot for receiving a screwdriver drive; and
a peripheral wall disposed horizontally radially from said recess; said peripheral wall having diametrically opposed parallel flats for horizontally receiving an open-end wrench.

5. The extension of claim 4 wherein:
said top end includes:
a radially protruding shoulder at the bottom of said flats.

6. The extension of claim 4 wherein:
said peripheral wall is substantially a regular polygon in cross-section.

7. The extension of claim 6 wherein:
said top end includes:
a radially protruding shoulder at the bottom of said flats.

8. The extension of claim 4 wherein:
said peripheral wall extends to said free end and is adapted to receive a box wrench, a flat reversible ratchet wrench or socket wrench.

9. The extension of claim 4 wherein:
said peripheral wall is substantially a regular polygon in cross-section having an equal number of flats; and
said top end portion includes:
a diametrical bore though each said flat.

10. A socket wrench extension including:
a tool mounting first end portion;
a shank portion; and
a torque receiving top end portion including:
a free end face;
an axial, drive-receiving recess in said free end face; said drive-receiving recess including a bottom end including a slot for receiving a screwdriver blade; and
a peripheral wall that extends to said free end and is substantially a regular polygon in cross-section having diametrically opposed parallel flats for receiving an open-end wrench, a box wrench, flat reversible ratchet wrench or socket wrench.

11. The extension of claim 10 wherein:
said top end includes:
a radially protruding shoulder at the bottom of said flats.

12. The extension of claim 10 wherein:
said top end portion includes:
a diametrical bore though each said flat.

13. A socket wrench extension including:
a tool mounting bottom end portion;
a shank portion; and
a torque receiving top end portion including:
a free end face;
an axial, drive-receiving recess in said free end face; said drive-receiving recess including a bottom end including a slot for receiving a screwdriver drive; and
a peripheral wall disposed horizontally radially from said recess; said peripheral wall having diametrically opposed parallel flats for horizontally receiving an open-end wrench; said peripheral wall being substantially a regular polygon in cross-section having an equal number of flats including a diametrical bore though each said flat.

14. A socket wrench extension including:
a tool mounting first end portion;
a shank portion; and
a torque receiving top end portion including:
a free end face;
an axial, drive-receiving recess in said free end face including a bottom end including a slot for receiving a screwdriver drive; and
a plurality of radially-spaced diametrical bores therethrough.

15. The extension of claim 14 wherein:
said top end portion includes:
a peripheral wall that extends to said free end and is substantially a regular polygon in cross-section having diametrically opposed parallel flats for receiving an open-end wrench, a box wrench, flat reversible ratchet wrench or socket wrench.

16. The extension of claim 15 wherein:
said top end includes:
a radially protruding shoulder at the bottom of said flats.

17. The extension of claim 15 wherein:
each said flat has a said diametrical bore therethrough.

* * * * *